United States Patent [19]

Hutchinson

[11] 4,168,827

[45] Sep. 25, 1979

[54] CARPENTER'S DOOR CLAMP DEVICE

[76] Inventor: Raymond L. Hutchinson, The Oaks Mobile Home Park No. 30, Mt. Washington, Ky. 40047

[21] Appl. No.: 880,938

[22] Filed: Feb. 24, 1978

[51] Int. Cl.[2] ..... B25B 1/04

[52] U.S. Cl. ..... 269/238; 269/321 F

[58] Field of Search ..... 269/17, 321 F, 238; 248/469, 472, 526, 466

[56] References Cited

U.S. PATENT DOCUMENTS

| | | | |
|---|---|---|---|
| 3,371,896 | 3/1968 | Cox | 248/526 X |
| 3,861,662 | 1/1975 | Morse | 269/321 F X |

FOREIGN PATENT DOCUMENTS

| | | | |
|---|---|---|---|
| 1237519 | 6/1960 | France | 248/472 |

*Primary Examiner*—Robert C. Watson

*Attorney, Agent, or Firm*—Francis H. Boos; Maurice L. Miller, Jr.

[57] ABSTRACT

A carpenter's door clamp device with two clamping segments hinged together so as to pivot apart for insertion and removal of the door. Fulcrum spacers are mounted on the bottom of one or both clamp segments to enable the clamp to operate by the weight of the door and also to permit quick opening and closing of the clamp by simply applying and removing foot pressure at the outer end of the clamp segment.

2 Claims, 2 Drawing Figures

CARPENTER'S DOOR CLAMP DEVICE

BACKGROUND OF THE INVENTION

This invention relates to a carpenter's door clamp device. More specifically, it relates to such a device which can be used by carpenters to hold a door on its edge in an upright position, thus enabling the carpenter to plane an edge of the door or mount hinges on the edge preparatory to hanging the door on a door jamb.

Typically, preparing to hang a door involves the mounting of hinges on the door edge and possibly also the planing of excess material from the edge. It is very awkward to hold the door in this position while attempting to work on the door. The carpenter may hold the door with one hand or with his knees or may try to prop it against a saw horse or other support. It is, therefore, considered desirable to provide a more convenient means to assist the carpenter in this effort and to this end relatively complicated mechanisms have been proposed in the past. An example may be found in U.S. Pat. No. 3,861,662 issued to C. W. Morse on Jan. 21, 1975. This patent discloses a wheeled clamping device that does assist the carpenter in holding the door upright but has the disadvantage of being cumbersome, relatively expensive and also time consuming to manipulate using, as it does, screw clamps to hold the door upright. A more convenient, lower cost device is to be preferred by carpenters.

OBJECTS AND BRIEF INVENTION SUMMARY

It is, therefore, an object of the present invention to provide a carpenter's door clamp device that is small, convenient to use, and inexpensive to produce.

To this end, a carpenter's door clamp device constructed in accordance with the present invention comprises a pair of clamp segments, each of which has an elongated base and at least one vertical side generally perpendicular to the base thereof. There is also provided hinge means mounted on the segment bases so as to hold the aforementioned vertical sides in opposing relationship and spaced apart approximately by an amount equal to the width of a door to be held between the vertical sides. The hinge is arranged to enable the segments to pivot open so as to allow insertion of the door between the vertical sides as well as the removal of the door therefrom. Fulcrum means are mounted beneath at least one of the segment bases and spaced inwardly from the end thereof remote from the hinge thereby enabling a user to open the device by exerting a force on the remote end of the segment's base, for example, by use of foot pressure.

DETAILED DESCRIPTION OF THE INVENTION

Figure 1:
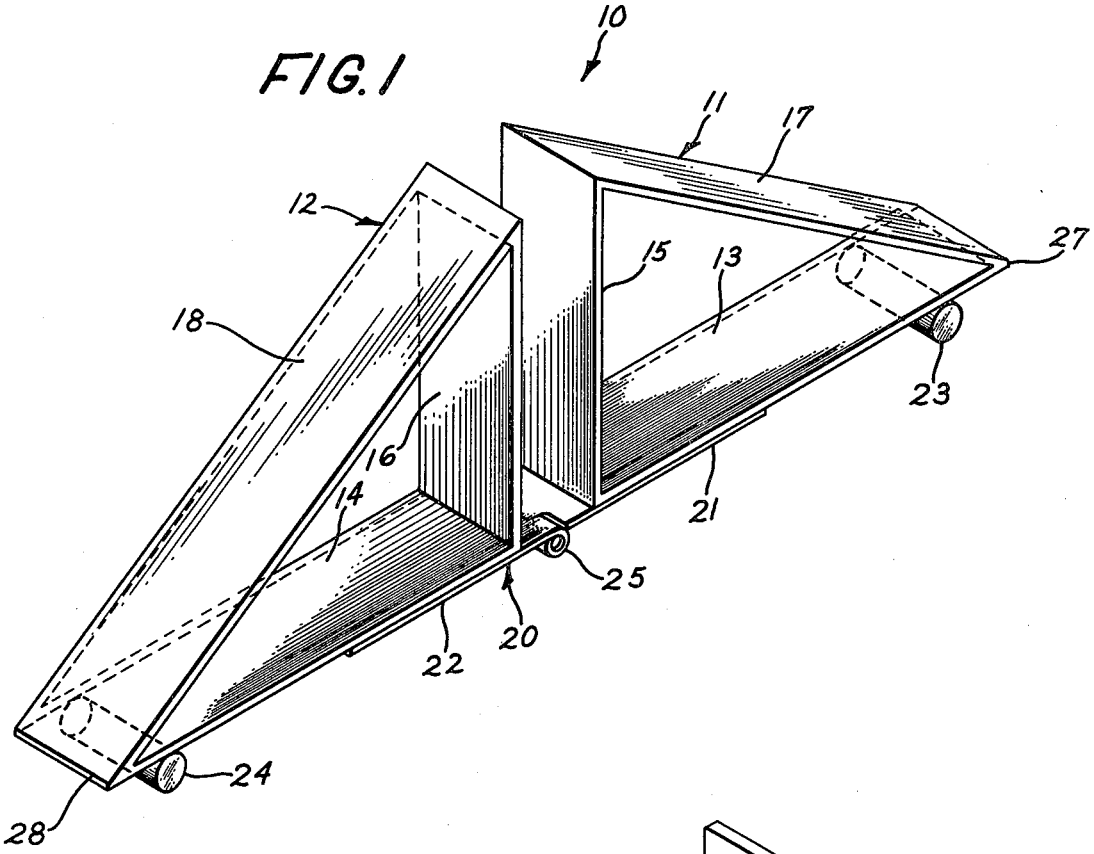
FIG. 1 is a perspective view of a door clamp device constructed in accordance with the invention.

Referring now to FIG. 1 of the drawings, there is shown a door clamp device 10 comprising two clamp segments 12 and 14 held in planar alignment by means of hinge 20. As illustrated in the drawing, each of the clamp segments 12, 14 is formed in the shape of a right triangle repectively having bases 13, 14 and at least one vertical side 15 and 16. Preferably sides 15 and 16 are generally perpendicular to bases 13, 14. Segments 11 and 12 further include sloping sides 17 and 18 thus completing the structure of each segment. Any sturdy material may be used in the structure of the segments, steel, aluminum or plastic being considered possible. While the segments are shown as comprising discrete lengths of material, other possibilities are apparent, such as a solid configuration.

Hinge plates 21 and 22 are mounted by suitable means to the segment bases 13 and 14, respectively, such that segment vertical sides 15 and 16 are in opposing relationship and are spaced apart generally by an amount equal to the thickness of the door that is to be clamped therebetween. With this arrangement, and with hinge pin 25 facing downward, the clamp segments 11 and 12 can be pivoted apart permitting ready entry and removal of the door from between clamp sides 15 and 16.

In particular accord with the invention, fulcrum pins 23 and 24 are mounted by suitable means such as by welding or with screws to the segment bottom sides 13 and 14 respectively. Each of the pins 23 and 24 are spaced inwardly from the tips 27 and 28 of the bottom sides, the tips being remote of the hinge 20. While the precise positioning of fulcrum pins 23, 24 is not critical, they are preferably placed approximately 1½ inches in from the ends to provide suitable leverage with which to open the device by exerting force on the lower end of either or both of the sloped sides 17, 18. Ordinarily, foot pressure applied to one segment base end is sufficient.

In operation thereof, a carpenter sets the device 10 on the floor as shown and merely uses foot pressure on either segment 11 or 12 at the remote end 27 or 28 to open the clamp. The carpenter then inserts the door, releases the foot pressure and the door remains clamped by the weight of the door in the desired upright position. Upon completion of the work, foot pressure applied to either remote end 27 or 28 quickly opens the device thus permitting easy removal of the door.

Figure 2:
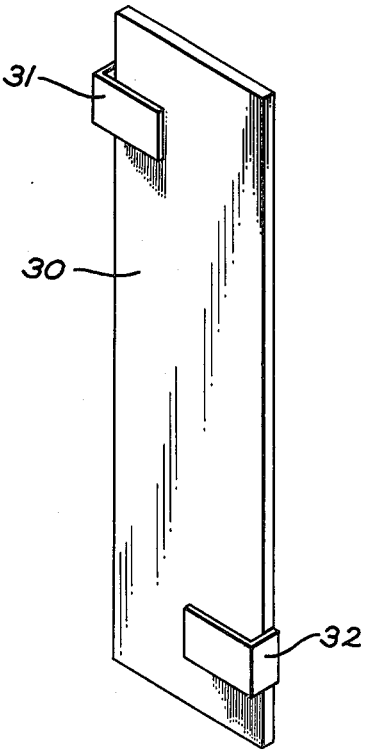
FIG. 2 is a perspective view of an adapter that may be used with the device of FIG. 1 for use in clamping to thinner doors.

Preferably, the lateral spacing between the opposing vertical sides 15 and 16 is equal to the thickness of the standard door to be clamped in place, for example, 1¾ inches. In some cases, it may be desired to clamp a thinner door and in this case an adapter as shown in FIG. 2 can be slipped onto one of the vertical sides 15 or 16 of the clamp device 10. Referring to FIG. 2, there is shown an adapter 30 of suitable material which may be of the same width and length as the vertical sides 15, 16. The thickness of adapter 30 is chosen to provide the desired space reduction between the sides 15, 16 to permit clamping of the thinner door. Clips 31 and 32 are provided on opposite edges of adapter 30 to enable the adapter to be rotated onto the selected clamp side and held in place thereby.

Exemplary dimensions for each clamp device are as follows:

| | Length | Width | Thickness |
|---|---|---|---|
| Segment base 13, 14 | 10⅛" | 2" | ⅛" |
| Vertical side 15, 16 | 6" | 2" | ⅛" |
| Sloped side 17, 18 | 11¾" | 2" | ⅛" |
| Hinge 20 | 18" | 2" | ⅛" |

While, in accordance with the patent statutes, there has been described what at present is considered to be the preferred embodiment of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. A carpenter's door clamp device comprising a pair of clamp segments each having an elongated base and at least one vertical side generally perpendicular to the base;

hinge means mounted on said segment bases holding said segments with said vertical sides thereof in opposing relationship and spaced apart by the thickness of the door to be held, said hinge means enabling the segments to pivot open to allow insertion of the door between the vertical sides;

and fulcrum means mounted beneath at least one of said bases and spaced inwardly from the end thereof which is remote from the hinge means, whereby a user of said device can readily open the device for insertion and removal of the door by exertion of force on said remote end of the segment's base.

2. The carpenter's door clamp device of claim 1 further including a removable adapter having means for clamping the adapter on one of said vertical sides, the thickness of the adapter being sufficient to take up space between said clamp vertical sides and a door inserted therebetween which is thinner than the spacing between said vertical sides.

* * * * *